United States Patent [19]

Rehbein

[11] Patent Number: 4,697,528

[45] Date of Patent: Oct. 6, 1987

[54] RAILWAY TANK CAR WITH PROTECTIVE DEVICE FOR PROTRUSION

[75] Inventor: Richard E. Rehbein, Valparaiso, Ind.

[73] Assignee: Pullman Rail Leasing Inc., Chicago, Ill.

[21] Appl. No.: 853,478

[22] Filed: Apr. 18, 1986

[51] Int. Cl.[4] ..... B61D 5/00; F16K 35/00

[52] U.S. Cl. ..... 105/358; 251/144; 137/350; 137/382; 220/85 P

[58] Field of Search ..... 105/358, 360, 362; 251/144; 137/377, 382, 347, 348, 350; 220/85 P

[56] References Cited

U.S. PATENT DOCUMENTS

| | | | |
|---|---|---|---|
| 2,613,462 | 10/1952 | Johnson | 220/85 P X |
| 2,675,017 | 4/1954 | Fredrickson et al. | 137/382 X |
| 4,184,663 | 1/1980 | Rollins et al. | 251/144 |
| 4,220,097 | 9/1980 | Wempe et al. | 105/360 |
| 4,237,928 | 12/1980 | Messersmith | 137/350 X |
| 4,394,002 | 7/1983 | Polley | 251/144 |
| 4,461,397 | 7/1984 | Portis | 220/85 P |
| 4,527,489 | 7/1985 | Schlink | 105/358 |

*Primary Examiner*—Robert B. Reeves
*Assistant Examiner*—Scott H. Werny
*Attorney, Agent, or Firm*—Richard J. Myers & Associates

[57] ABSTRACT

A protective flange is provided for the protection of a protrusion or valve on the surface of a tank car. The flange has an inner arcuate wall and an outer deflection portion for receiving impacts. The inner wall is annular and spaced from the protrusion to provide for mounting over the protrusion without cutting into the tank car. The outer portion includes longitudinally extending slope portions and vertical side walls welded to the tank car surface. The flange is tapered to deflect impacts received at the sides of the flange. The outer deflection portion and the inner wall define a closed space surrounding the protrusion or valve. Steam connections may be made to the flange to introduce steam into the closed space for heating the valve.

25 Claims, 14 Drawing Figures

FIG. 8
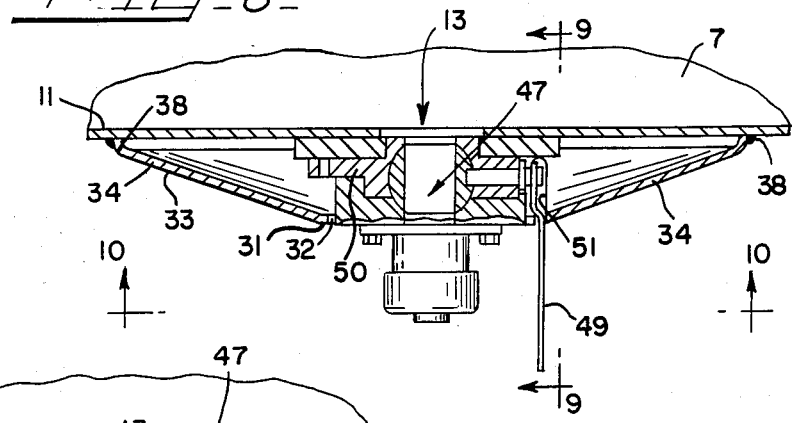
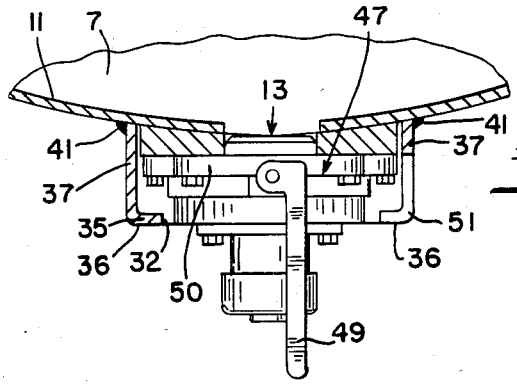
FIG. 9
FIG. 11
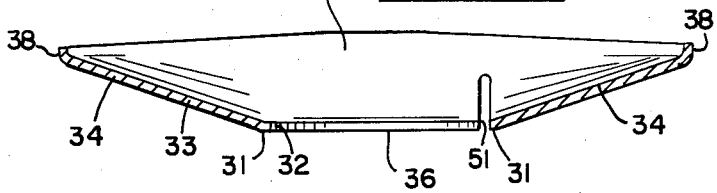
FIG. 10
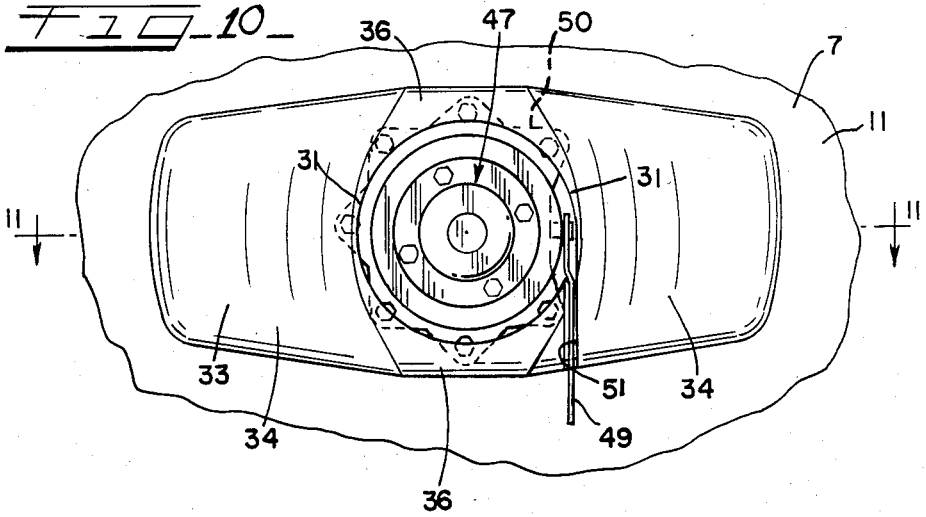

RAILWAY TANK CAR WITH PROTECTIVE DEVICE FOR PROTRUSION

BACKGROUND OF THE INVENTION

1. Field of the Invention

This invention relates to protective devices for preventing damage to valves in railway tank cars generally used for carrying various liquid cargoes. More particularly this invention relates to a protective flange used to prevent damage to a valve protruding from the bottom of a tank car.

2. Description of the Prior Art

The Association of Americal Railroads (AAR) railway tank car regulations E9.00 and E10.00 (Appendix E) require that bottom discontinuities which extend radially in excess of one inch beyond the surface of the tank be provided with an approved protective device which in an accident can receive severe impact without producing impact damage to the bottom discontinuity that could permit release of the contents of the tank. Bottom discontinuities are generally projecting parts of sumps, washout nozzles, or bottom outlet types of valves used for draining the tank car.

The usual method for adapting existing tank cars to comply with the AAR requirement was to cut around a non-complying valve on a tank, to remove the valve, and to then secure a combined valve and protective device in the opening left in the tank. Various combined valve and protective device structures may be found in the prior art, as, for example, those shown in U.S. Pat. Nos. 4,180,242; 4,184,663; and 4,394,002. However, the cutting of the tank and the replacement of the valve required by these structures are costly in terms of both time and materials.

SUMMARY OF THE INVENTION

Accordingly, it is an object of this invention to provide a protective flange which may be readily installed on a tank car to protect an existing valve or other protrusion without the necessity of cutting into the tank or replacing the valve or protrusion. A protective flange is provided having an inner cylindrical portion which encircles the protrusion and engages the bottom of the tank car. The inner cylindrical portion is connected with an outer skid portion which is sloped in accordance with AAR regulations to provide a deflecting surface for impacts. The flange is also tapered longitudinally to improve protection against impacts.

It is also an object of this invention to provide a flange which may be adapted to fit over one of a variety of valve types.

It is further an object of this invention to provide a protective flange which may be connected with a source of steam to heat the circumference of the valve to protect the valve from freezing and aid in the removal of congealable fluids from the tank during cold weather.

BRIEF DESCRIPTION OF THE DRAWINGS

FIG. 8 is a partially cut away elevational view of an alternate embodiment of the protective flange used to protect a low profile ball valve on a tank car.

FIG. 9 is a section view taken along line 9—9 of FIG. 8.

FIG. 10 is a view of the alternate embodiment taken along line 10—10 in FIG. 8.

FIG. 11 is a sectional view of the protective flange taken along line 11—11 in FIG. 10, but having the low profile ball valve removed to show the configuration of the flange.

DESCRIPTION OF PREFERRED EMBODIMENT

Figure 1:
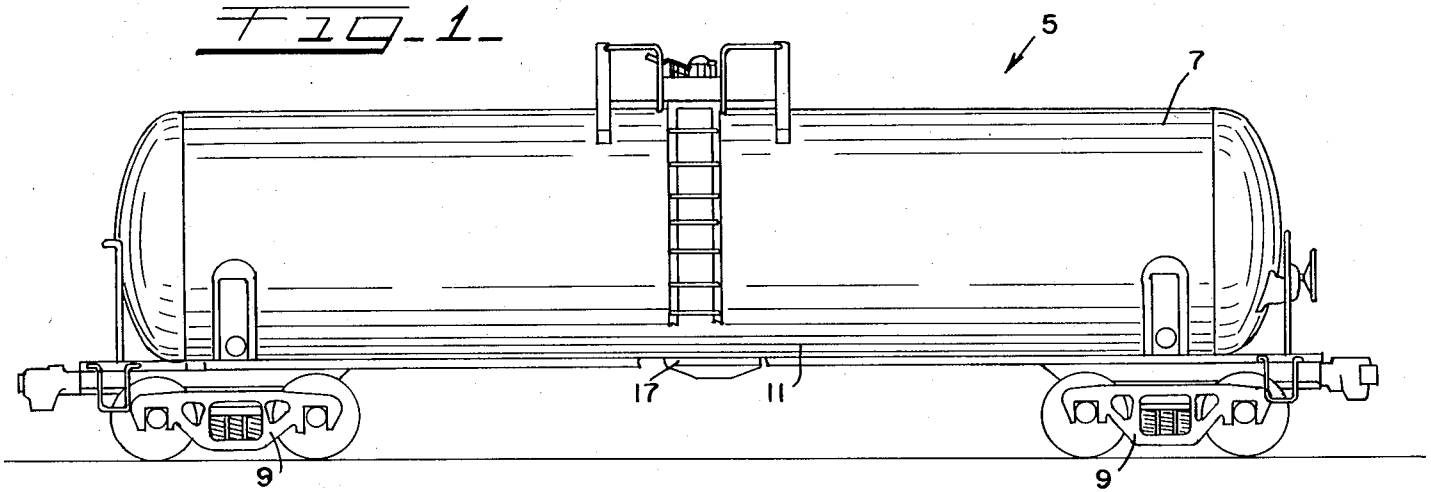
FIG. 1 is a side elevational view of a railway tanker car having the protective flange of this invention installed thereon.

Referring to FIG. 1, a railway tanker car generally indicated at 5 comprises a tank body portion 7 supported on a pair of railway wheel trucks 9. The tank body portion 7 is hollow for receiving liquid cargo. As best shown in in FIGS. 1 and 2, the bottom 11 of the tank car has an opening therein indicated at 13. The opening is covered by a washout nozzle or valve means 15 suported below the bottom 11 of the tank 7.

A protective flange 17 is mounted surrounding the valve 15 to protect it in accordance with AAR regulations which require that a protrusion more than one inch beyond the exterior surface of the tank car be equipped with a protective device. Protective flange 17 includes an inner generally cylindrical arcuate wall 19 encircling the nozzle 15. Wall 19 extends generally vertically and at the upper end thereof has an abutment portion 21 abutting the bottom 11 of the tank 7. The inner surface 23 of wall 19 is spaced from the nozzle 15 to insulate the nozzle against impacts applied to the flange 17 and to allow for ready mounting of the flange 17 over the nozzle 15. Surface 23 extends vertically toward the upper end of the cylindrical wall 19 where it meets tapered wall portion 25 which angles axially upward and radially outward from the upper end of inner surface 23. Tapered portion 25 is provided in wall 19 to accommodate weld 27 which attaches nozzle 15 to bottom portion 11 of the tank 7.

The lower end of cylindrical wall 19 has a generally horizontal bottom surface 31, and defines a generally circular aperture 32 in horizontal surface 31. Aperture 32 allows an operator ready access to the nozzle 15 through the flange 17.

Figure 6:
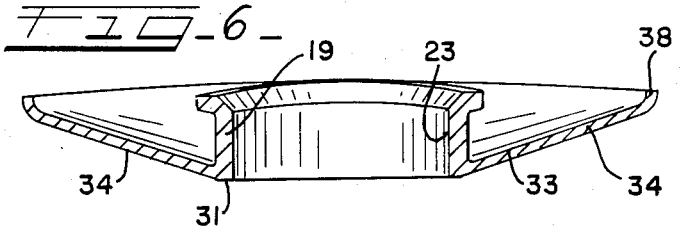
FIG. 6 is a section view of taken along line 6—6 of FIG. 5.
Figure 4:
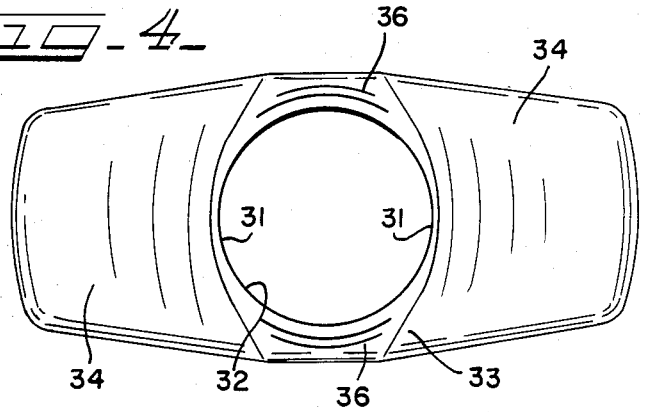
FIG. 4 is a bottom view of the protective flange of this invention.

As best shown in FIGS. 4 and 6, an outer deflection portion 33 is connected to the lower end of cylindrical wall 19 and extends radially away from wall 19. Deflection portion 33 includes slope portions 34 which extend longitudinally away from the wall 19 and angularly upward toward the bottom portion 11 of the tank 7. The upper end portions of slope portions 34 curve upwardly to provide connection portions 38 which abut the bottom member 11 at a generally perpendicular angle for facilitating welding. Slope portions 34 are angled with respect to surface 11 to provide an impact surface having a graduated slope of 3 units of length for each unit of vertical protrusion of a protective device, as required by AAR regulations. The bottom portion 11 of the tank 7 is generally cylindrical which results in the slope portions 34 being conforming generally cylindrical sections extending away from the bottom portion 11 at a 3-to-1 slope.

Deflection portion 33 also includes horizontal portions 35 which extend laterally outward from cylindrical wall 19 and have a lower generally horizontal surface 36 which is a planar extension of horizontal surface 31. Horizontal surfaces 31 and 36 lie in the shear plane of the flange 17, that is, the horizontal plane below which the protective flange 17 extends no protection and below which protruding structures may be expected to be sheared off in the event of a severe impact.

Figure 5:
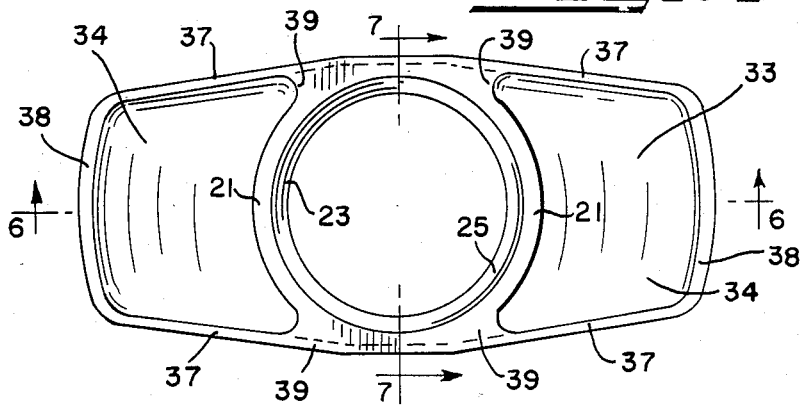
FIG. 5 is a plan view of the protective flange of this invention.

As shown in FIGS. 4 and 5, the deflection portion 33 also is tapered longitudinally to deflect impacts directed along the sides of the flange 17.

The deflection portions 33 is symmetrical with respect to a transverse plane extending through its longitudinal midpoint to provide equal protection against impacts during forward and rearward movement of the car.

Horizontal portions 35 extend laterally from wall 19 and are connected at their laterally outward edges to generally vertical side wall portions 37 of deflection portion 33. Side wall portions 37 are formed integral with the slope portion 34 and extend between horizontal portions 35 of flange 17 and bottom portion 11 of the tank 7. The tapering of deflection portion 33 and the use of generally vertical side wall portions 37 results in a protective flange which receives the minimum impacts necessary to protect the valve.

Figure 7:
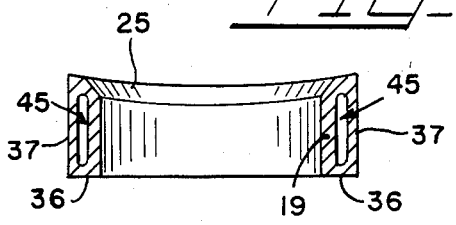
FIG. 7 is a section view taken along line 7—7 of FIG. 5.

As best shown in FIGS. 5 and 7, abutment portions 21 extends around the upper end of the cylindrical inner wall 19 and connects to side wall portion 37. Bridge members 39 extend between a portion of abutment portion 21 and side wall portions 37 and provide a smooth transition curve between the two.

Figure 3:
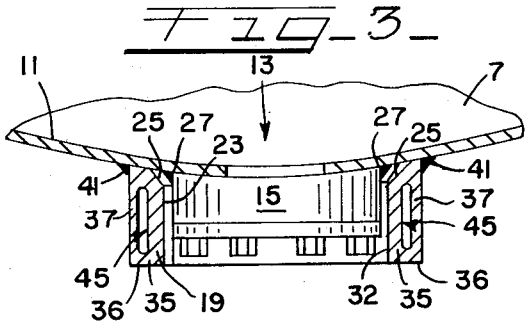
FIG. 3 is a partial section view taken along taken along line 3—3 of FIG. 2.
Figure 2:
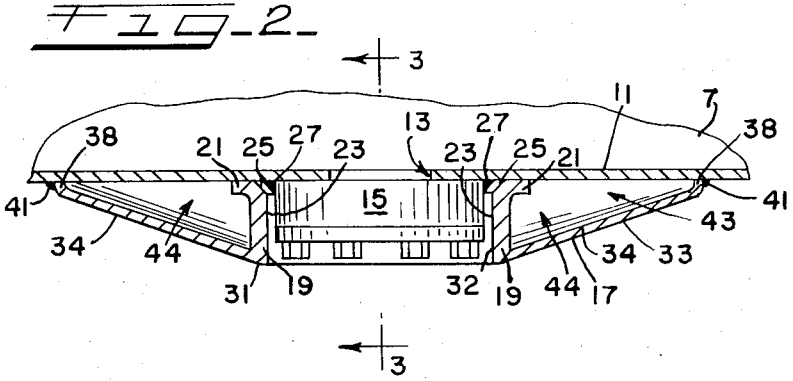
FIG. 2 is a detailed section view of the protective flange, taken along the longitudinal centerline thereof.

As best shown in FIGS. 3 and 7, the bottom portion 11 is a portion of the generally cylindrical shaped tank 7 and in lateral cross section has an arcuate downwardly convex curve. Flange 17 is configured with a complementary upwardly concave curve in the upper portions of abutment portions 21, connection portions 38, side wall portions 37, and bridge members 39 to engage the bottom 11 in a flush engagement. As shown in FIGS. 2 and 3, the flange is secured to the bottom 11 of the tank car 5 by welds 41 extending around perimeter of the flange 17 and being connected to the top of vertical wall portions 37 and connection portions 35. The flush connection of the flange 17 with bottom 11 of the tank 7 results in an isolated internal space generally indicated at 43 between the flange 17 and bottom 11 of tank 7. The space 43 includes two larger spaces 44 between slope portions 34 and the tank bottom 11. These larger spaces 44 are connected by channel spaces generally indicated at 45 extending between wall 19 and side wall portions 37. As a result, internal space 43 is a single interconnected space. The space 43 results in a relatively lightweight protective flange.

With reference to FIGS. 8, 9, 10, and 11, an alternate embodiment of the flange 17 described above is adapted for use with a low profile ball bottom-outlet valve generally indicated at 47. Similar parts are provided with the same reference members as in the figures relating to the preferred embodiment. The low profile ball valve 47 is provided with a handle 49 which may be rotated from a horizontal valve-closed position (FIG. 10) to a vertical valve-open position (FIG. 9).

The body 50 of the low profile ball valve 47 is somewhat larger in diameter than the washout nozzle 15 shown in FIGS. 2 and 3. As a consequence, the inner cylindrical wall 19 is removed to enable the flange 17 to fit over the valve 47. This results in considerable additional space being available. Once the inner cylindrical wall 19 is removed, the flange 17 is mounted over the valve 47 and secured in place by peripheral welds 41. Deflection portion 33 remains, including slope portion 34, shear plane surface 36, and side wall portions 37 and the outer deflecting surface is generally the same as in the preferred embodiment. The deflection portion 33 defines an annular space surrounding the valve 47 to isolate it from the shock of impacts.

As shown in FIGS. 8 and 9, a lower extension portion of low profile ball valve 47 extends below the valve and lower end of flange 17 and beyond the shear plane thereof. Low profile ball valve 47 is designed to allow this bolted lower extension to be sheared away completely without affecting the integrity of the seal of opening 13 of the valve 47, which is maintained by the part of the valve 47 protected within the flange 17.

To accommodate the handle 49, the flange 17 is provided with a slot 51. As best shown in FIG. 10, slot 51 extends laterally from aperture 32, across horizontal surface 31, and partially up the side wall portion 37. When rotated to the horizontal position, handle 49 enters slot 51, as shown in FIG. 10. This acts to protect a portion of the handle 49 in case of impact, and because the slot 51 extends laterally while impacts will be generally longitudinally directed, the handle 49 is protected against being moved to open the valve by impacts.

Figure 12:
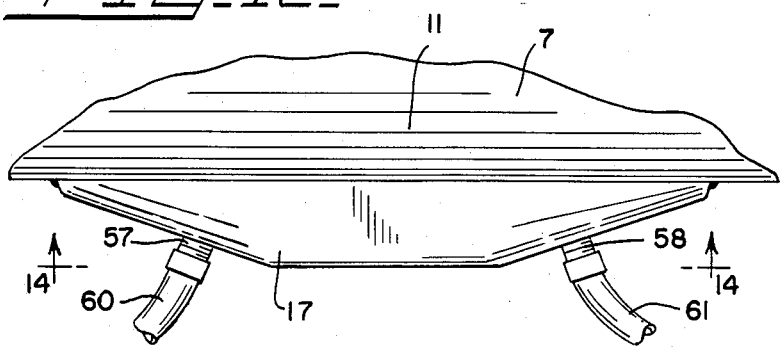
FIG. 12 is an elevational view of the protective flange having the additional feature of steam connections to provide for heating the valve on the tank.
Figure 13:
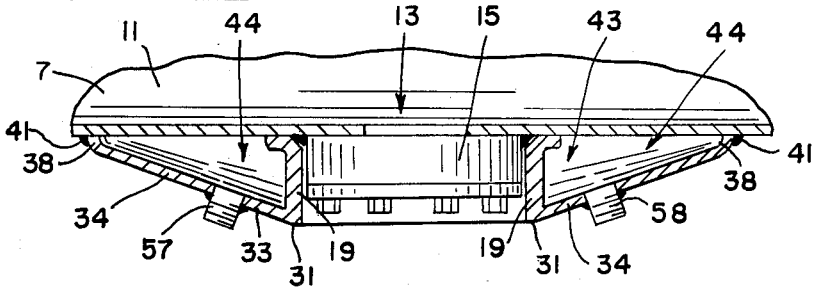
FIG. 13 is a partially cut-away elevational view as in FIG. 12, showing the interior of the protective flange with the steam connections.
Figure 14:
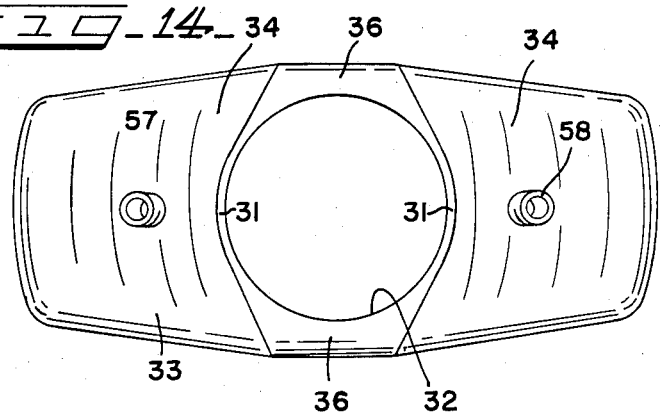
FIG. 14 is a view taken along line 14—14 of FIG. 12.

With reference to FIGS. 12, 13, and 14, it is shown that the protective flange 17 may be provided with steam heating for the valve 15 in cold weather operation. As best shown in FIG. 13, flange 17 is provided with steam inlet and outlet fixtures 57 and 58. Fixtures 57 and 58 communicate with internal space 43 and are connected with steam carrying tubes 60 and 61. Tube 60 supplies steam which passes through the inlet fixture 57 and into first space 44. The steam flows through the channel spaces 45 to the lateral sides of wall 19 and to the second space 44 at opposite longitudinal end of flange 17. The steam then flows through outlet fixture 58, and is carried to other uses by tube 61. Thus, wall 19 is surrounded by steam-filled space 43 and its cylindrical shape provides for effective warming of the valve 15, which it encircles. The inlet and outlet fixtures 57 and 58 are positioned on approximately the centerline of slope portions 34 to provide for optimal dispersion of the steam and its heat within the flange 17. Inlet and outlet fixtures 57 and 58 are located toward the lower ends of slope portions 34 to facilitate draining of the steam and any condensation from inside the flange 17.

The foregoing description and drawings merely explain and illustrate the invention, and the invention is not limited thereto, except insofar as the appended claims are so limited, as those skilled in the art who have this disclosure before them will be able to make modifications and variations therein without departing from the scope of the invention.

Wherefore I claim:

1. A railway tank car including a tank body having an outer surface and a protrusion thereon, and a protective device for protective said protrusion against damage from impacts, said protective device comprising:

a generally cylindrical inner wall means completely surrounding and spaced from the protrusion, said wall means engaging the surface of the tank body and extending generally away therefrom, said wall means having a first end portion engaging the tank body and a second end portion defining an access aperture in the protective device for providing access to the protrusion;

an outer deflection portion connected with the second end portion of the wall means, said deflection portion extending radially outwardly and slopingly toward the tank body, said deflection portion engaging the outer surface of the tank body for deflecting impacts and protecting the protrusion;

the inner wall means having an outer surface portion facing generally away from the protrusion, and the outer deflection portion having an inner surface portion facing inwardly of the protective device;

the outer surface of the tank body, the outer surface portion of the inner wall means, and the inner surface portion of the outer deflection portion defining therebetween an internal space extending completely around the protrusion within the protective device whereby the protective device is lightweight and may be mounted over the protrusion without cutting into the tank body.

2. The invention according to claim 1, and said inner wall means defining with said outer surface and said protrusion a generally annular space for isolating the protrusion from shocks received by the protrusion device.

3. The invention according to claim 1, and said inner wall means and said deflection portion being in substantially flush engagement with the outer surface of the tank car whereby the internal space defined is substantially closed and isolated from the space surrounding the protective device.

4. The invention according to claim 1, and the protrusion comprising a washout nozzle.

5. The invention according to claim 1, and the deflection portion having a steam inlet means and a steam outlet means communicating with the internal space of the device whereby the protrusion may be heated during cold weather by causing steam to enter the internal space surrounding the protrusion.

6. The invention according to claim 1, and said deflection portion being substantially symmetrical with respect to a longitudinal center-line for deflecting impacts received during forward and rearward movement of the railway car.

7. The invention according to claim 1, and said deflection portion having two longitudinally opposite ends connected by a middle portion connected with the inner wall means, said ends tapering longitudinally away from the middle portion for deflecting impacts directed at the sides of the protective device.

8. The invention according to claim 1, and said outer surface of said inner wall means extending substantially the length of the protrusion whereby the internal space extends substantially the length of the protrusion for added protection thereof.

9. The invention according to claim 1, and said outer deflection portion including a pair of laterally spaced side wall portions engaging the surface of the tank body and extending away therefrom in a direction substantially parallel to the direction of extension of the protrusion away from the tank body.

10. The invention according to claim 1, and said first portion of the inner wall means having a taper surface portion extending away from the protrusion and toward the tank body, and defining a clearance space extending around the protrusion adjacent the outer surface of the tank body.

11. The invention accordig to claim 1, and said first portion of the inner wall means having an abutment portion engaging the outer surface of the tank body and extending generally radially outwardly with respect to the protrusion beyond the outer surface of the inner wall means for engagement of the inner wall means with the outer surface of the tank body.

12. The invention according to claim 1, and said protective device engaging only the outer surface of the tank body for isolating the protrusion against impacts.

13. The invention according to claim 12, and the surface of the tank body extending continuously outwardly from the protrusion.

14. The invention according to claim 13, and the protective device being secure to the tank body solely by securement means fixedly connecting only the outer deflection portion with the outer surface of the tank body.

15. The invention according to claim 1, and said outer deflection portion comprising a pair of longitudinally opposing slope portions connected with the inner wall means and extending longitudinally away therefrom, the slope portions extending slopingly toward the outer surface of the tank body and being connected thereto for deflecting impacts directed toward the protrusion.

16. The invention according to claim 15, and the slope portions being angled to extend three units longitudinally for each unit of distance that the slope portions extend away from the outer surface of the tank body.

17. The invention according to claim 15, and said slope portions having connection portions engaging the outer surface of the tank body at a generally perpendicular angle, and weld means connecting the connection portion with the outer surface of the tank body.

18. The invention according to claim 15, and the deflection portion having a pair of generally vertical wall portions each being connected with both of the slope portions and extending therebetween.

19. The invention according to claim 18, and a pair of horizontal portions connected to the inner wall means and extending outwardly therefrom, each of the horizontal portions being connected to a respective wall portion.

20. The invention according to claim 18, and bridge portions connecting the inner wall means with the vertical wall portions.

21. A railway tank car including a tank body having an outer surface and a protrusion thereon, and a protective device for protecting said protrusion against damage from impacts, said protective device comprising:

a generally cylindrical inner wall means completely surrounding and spaced from the protrusion, said wall means engaging the surface of the tank body and having a first end portion engaging the tank body and a second end portion defining an access aperture in the protective device for providing access to the protrusion;

an outer deflection portion connected with the second end portion of the wall means, said deflection portion extending radially outwardly and slopingly toward the tank body, said deflection portion engaging the outer surface of the tank body for deflecting impacts and protecting the protrusion;

said outer deflection portion comprising a pair of longitudinally opposing slope portions connected with the inner wall means and extending longitudinally away therefrom, the slope portions extending slopingly toward the outer surface of the tank body and being connected thereto for deflecting impacts directed toward the protrusion;

the deflection portion having a pair of generally vertical wall portions each being connected with both of the slope portions and extending therebetween;

the generally vertical wall portions and the inner wall means defining connecting spaces therebetween, and the slope portions and the outer surface defining end spaces therebetween connected with each other through the connecting spaces;

said end spaces and said connecting spaces together forming an internal space within the protective device whereby the protective device is lightweight and may be mounted over the protrusion without cutting into the tank body.

22. The invention according to claim 21, and the protrusion including a valve means for withdrawing the contents of the tank car;

steam inlet means connected with one of the slope portions for introducing steam in the associated end space; and steam outlet means connected with the other of the slope portions for withdrawing steam from the end space associated therewith, whereby steam flows from the steam inlet means to one of the end spaces, through the connecting spaces, and to the other of the end spaces to be withdrawn by the steam outlet means, and whereby the valve means is heated for use with congealable cargo in a cold environment.

23. A railway tank car comprising:

a tank body having an outer surface;

a protrusion on the outer surface of the tank body;

a protective device on the outer surface for protecting said protrusion against damage from impacts, said protective device comprising:

first and second generally vertical side wall portions spaced laterally from the protrusion and engaging the outer surface of the tank car;

first and second longitudinally spaced slope portions connected to the side wall portions and engaging the outer surface of the tank car and extending slopingly toward the protrusion for deflecting impacts directed theretoward;

said slope portions and said vertical side wall portions defining an opening in the protective device providing access to the protrusion, said slope portions and vertical wall portions being spaced from said protrusion for isolating the protrusion from impacts received by the protective device;

the protrusion comprising a valve means having a handle means thereon movable between a valve-closed position and a valve-open position for opening and closing the valve means to unload the tank car;

the protective device having a slot therein connecting with the opening;

the handle means extending through the opening in the protective device when in the valve-open position, and the handle means extending within the slot when in the valve-closed position for protecting the handle means against impacts;

said slot extending laterally with respect to the tank car whereby the handle means is protected against being moved by an impact to open the valve means.

24. The invention according to claim 23, and the slope portions tapering longitudinally away from the protrusion.

25. The invention according to claim 23, and a horizontal portion connected to the vertical side wall portions and the slope portions, said horizontal portion lying in the shear plane of the protective device.

* * * * *